United States Patent [19]

Watanabe

[11] Patent Number: 4,676,678

[45] Date of Patent: Jun. 30, 1987

[54] RIBBON CASSETTE CARTRIDGE HAVING A LID AND A LOCATOR SLOT

[75] Inventor: Junji Watanabe, Yokohama, Japan

[73] Assignee: Kabushiki Kaisha Toshiba, Kawasaki, Japan

[21] Appl. No.: 701,550

[22] Filed: Feb. 14, 1985

[30] Foreign Application Priority Data

Feb. 21, 1984 [JP] Japan ..... 59-30691
Mar. 31, 1984 [JP] Japan ..... 59-63554

[51] Int. Cl.[4] ..... B41J 32/00

[52] U.S. Cl. ..... 400/208; 400/120; 400/234; 400/240.3; 400/660.2

[58] Field of Search ..... 400/120, 207, 208, 208.1, 400/234, 240.3, 660.2; 101/336; 360/95; 242/198, 55.19 A, 189

[56] References Cited

U.S. PATENT DOCUMENTS

| | | | |
|---|---|---|---|
| 2,972,402 | 2/1961 | Howard | 400/234 X |
| 3,260,344 | 7/1966 | Doyle | 400/208 |
| 3,774,538 | 11/1973 | Bullock | 400/208 X |
| 3,924,727 | 12/1975 | Morelli | 400/208.1 |
| 3,952,649 | 4/1976 | Dikoff | 101/336 X |
| 3,976,183 | 8/1976 | Fleischmann et al. | 400/208 |
| 4,074,799 | 2/1978 | Hishida et al. | 400/234 X |
| 4,079,827 | 3/1978 | Work | 400/234 |
| 4,131,373 | 12/1978 | Rakow | 400/208 |
| 4,160,605 | 7/1979 | Neubaum | 400/208 |
| 4,188,134 | 2/1980 | Garrido | 400/208 |
| 4,213,715 | 7/1980 | Haftmann et al. | 400/207 X |
| 4,232,840 | 11/1980 | Sugawara | 242/198 |
| 4,350,451 | 9/1982 | Furrow | 400/208 |
| 4,367,963 | 1/1983 | Daughters | 400/208 |
| 4,378,566 | 3/1983 | Tsukamura | 346/76 PH X |
| 4,447,020 | 5/1984 | Toi et al. | 242/198 |
| 4,470,560 | 9/1984 | Yoneya et al. | 360/95 X |
| 4,472,753 | 9/1984 | Wulfing | 242/198 X |
| 4,511,271 | 4/1985 | Oberto | 400/234 X |
| 4,534,666 | 8/1985 | Watanabe | 400/207 |

FOREIGN PATENT DOCUMENTS

| | | | |
|---|---|---|---|
| 0377272 | of 0000 | Fed. Rep. of Germany . | |
| 3421639 | 12/1984 | Fed. Rep. of Germany . | |
| 3425953 | 1/1985 | Fed. Rep. of Germany . | |
| 3504029 | 8/1985 | Fed. Rep. of Germany . | |
| 0024478 | 2/1983 | Japan | 400/208 |
| 0131075 | 8/1983 | Japan | 400/240.3 |
| 257659 | 9/1926 | United Kingdom | 400/660.2 |

OTHER PUBLICATIONS

IBM Technical Disclosure Bulletin, "Cartridge Reel Brake", Rinkleib, vol. 27, No. 1B, Jun. 1984, p. 740.
Patents Abstracts of Japan, 4/30/83, vol. 7/No. 102, M-211.

*Primary Examiner*—Ernest T. Wright, Jr.
*Attorney, Agent, or Firm*—Cushman, Darby & Cushman

[57] ABSTRACT

A ribbon cassette cartridge detachably mounted to an image forming apparatus includes a multi-color ribbon wound around a pair of rollers mounted inside the cartridge. The cartridge has a lid which is opened to exchange the ribbon and roll shafts. The cartridge also includes a locator slot adapted to detachably mount the cartridge on a cooperating holder in the image forming apparatus. Holding means are provided in the cartridge to prevent the rollers from rotating when the cartridge is not mounted on the image forming apparatus.

14 Claims, 39 Drawing Figures

RIBBON CASSETTE CARTRIDGE HAVING A LID AND A LOCATOR SLOT

BACKGROUND OF THE INVENTION

The present invention relates to a transfer member device which is used in an image forming apparatus for forming an image on a sheet by transferring a color agent from the transfer member to the sheet in accordance with a latent image, and which stores the transfer member.

Among conventional image forming apparatuses of this type, there are thermal printers which print by heating a ribbon (transfer member) impregnated with a color agent. Generally, small-sized, low-priced, noise-free, and capable of printing on ordinary paper, these printing machines have recently been used in computers, recorders for the output of word processors, and copying apparatuses.

In a thermal printer of this type, two ends of a ribbon (transfer member) impregnated with a color agent are wound around corresponding roll shafts. When image transfer (image formation) is performed, the ribbon is take up from one roll shaft to the other roll shaft. When the ribbon is replaced with a new one, two roll shafts are removed one at a time. A new ribbon is wound around the two roll shafts which are then set in the thermal printer. In this manner, ribbon replacement in the conventional thermal printer is cumbersome, and the operator's hands become soiled as the operator holds the ribbon in order to replace the used ribbons with the new one. Wrinkles are also formed in the ribbon when it is touched.

SUMMARY OF THE INVENTION

It is an object of the present invention to provide a transfer member device wherein a transfer member can be easily replaced with respect to an image forming apparatus, an operator's hands will not become soiled at the time of transfer member replacement and wrinkles will not be formed in the ribbon.

According to an aspect of the present invention, there is provided a transfer member device detachably mounted in a holder of an image forming apparatus for forming an image by transferring a color agent to a sheet. The device comprises a transfer member having the color agent in a sheet-like shape with two ends, a pair of roll shafts, each engaged with one end of said transfer member, for winding said transfer member so as to feed said transfer member in one direction, and a case for surrounding the pair of roll shafts and the transfer member. One side of the case is open so that a portion of the transfer member which is located between the pair of roll shafts is exposed. The case has lid means for freely opening the case so as to allow the exchange of the pair of roll shafts, and the case has a slit located between the pair of roll shafts such that it is opened at one side of the case and extends part of the way toward the opposite end of the case, so that the transfer member device is guided through the slit into the holder and is held there when the transfer member device is set in the image forming apparatus.

DETAILED DESCRIPTION OF THE PREFERRED EMBODIMENTS

The preferred embodiments of this invention will will now be described in detail with reference to the drawings attached hereto.

Figure 1:
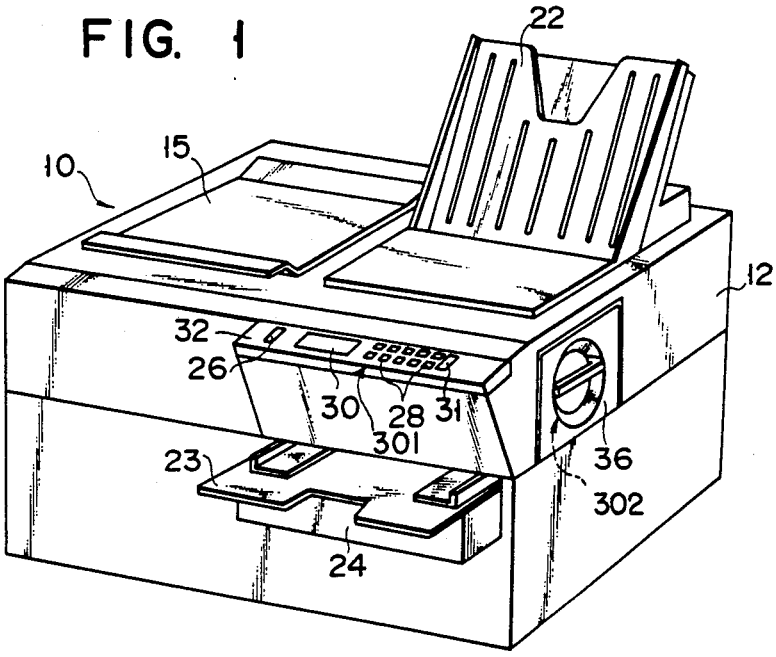
FIG. 1 is a perspective view of a thermal printer used for one embodiment of the present invention.
Figure 2:
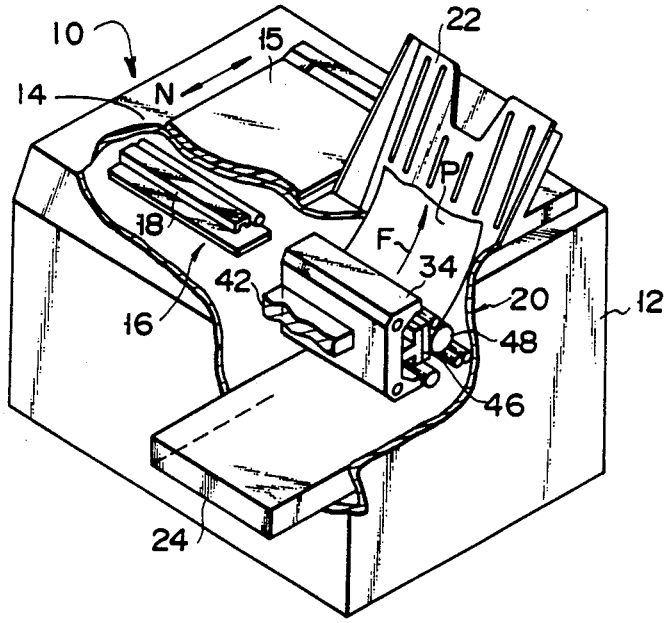
FIG. 2 is a broken away, perspective view schematically showing the printer of FIG. 1.

FIGS. 1 and 2 show a thermal printer as an image forming apparatus used for the present invention. As shown in these figures, the printer 10 comprises a housing 12 and an original table 14 provided in the upper side of the housing 12. An original to be copied (not shown but placed between table 14 and cover 15) may be placed on the table 14. The original table 14 is made of a transparent material such as glass and provided with a cover 15. A scanning unit 16 is provided within the housing 12, right below the table 14, to scan the original placed on the table 14. This unit 16 has a optical exposure system 18 which can move in the direction of arrow N to scan the original and to receive the light reflected from the original. The light the system 18 as received (i.e., the optical information) is converted into electric signals. An image forming unit 20 is provided in the central portion of the housing 12. As will be described later, this unit 20 is designed to form an image on a sheet of paper P in accordance with the electric signals supplied from the scanning unit 16. The sheet of paper P moves in the direction of the arrow R in FIG. 2.

A tray 22 is secured to the top of the housing 12. It receives printed sheets of paper P. A sheet cassette 24 is removably attached to the front of the housing 12. The cassette 24 contains sheets of paper P, which may be fed into the apparatus one by one. A control panel 32 is provided on the front of the housing 12, right above the cassette 24. The panel 32 includes a start button 26, a keyboard 301 with the keys 28, a display 30 for displaying warnings, e.g., "paper jamming," to the operator, and a button 31. When the button 26 is pushed, the apparatus starts. When the button 31 is pushed, a ribbon cassette 34 will be ejected.

A door 36 is attached to the right side of the housing 12 and usually covers an opening 302 made in this side of the housing 12. It is opened so that a ribbon cassette 34 may be inserted into the housing 12 or taken therefrom, through the opening 302. The door 36 has a lock mechanism (not shown) which locks the door 36 in accordance with signals input by pushing some of the keys 28 in a specific order.

Figure 3:
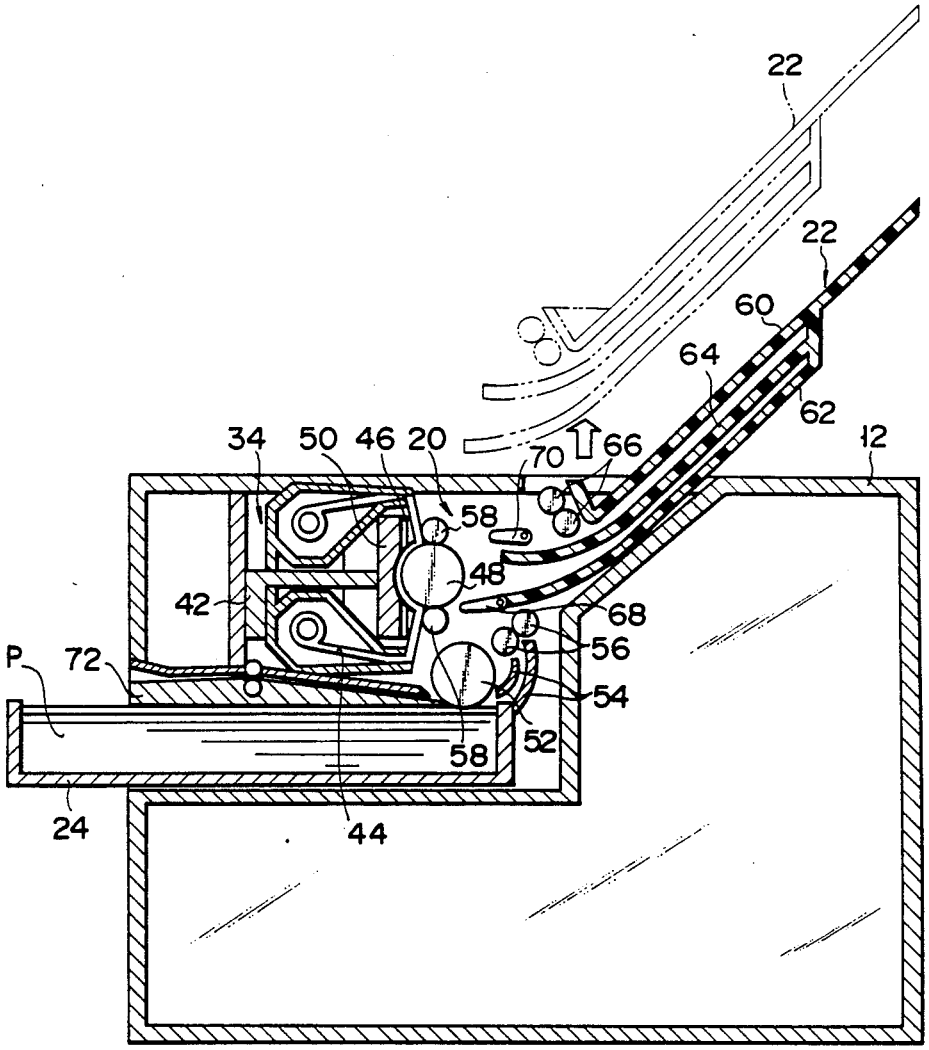
FIG. 3 is a vertical sectional view schematically showing the printer of FIG. 1.

The image forming unit 20 will be described in detail with reference to FIG. 3. The image forming unit 20 is provided with a holder 42 for holding the cassette 34 in place when the cassette 34 is inserted into the housing 12, and a thermal head 46 for heating the exposed portion of the ribbon 44, thereby to transfer inks from the ribbon 44 to a sheet P of paper. The head 46 comprises a number of heating elements (not shown) which are selectively driven by the electric signals supplied from the exposure system 18 to heat the ribbon 44 and transfer inks therefrom to the sheet P. The unit 20 further comprises a platen 48 which faces the head 46 with the ribbon 44 between them. The platen 48 can be moved to push the sheet P and the ribbon 44 onto the thermal head 46. A heat radiating board 50 is arranged at the back of the thermal head 46 to radiate heat from the head 46.

A roller 52 is placed at the front of the sheet cassette 24. When it is rotated by a drive means (not shown), a sheet P is fed out of the cassette 24. Arranged close to the roller 52 are a pair of guide plates 54 for guiding the sheet P from the roller 52 and a pair of aligning rollers 56 for aligning the front edge of the sheet P guided by the plates 54. Two backup rollers 58 on either side of the platen 48, which pinch it, cooperate to wind the sheet P (fed from the rollers 56) around the platen 48 and to keep the sheet P in contact with the platen 48.

The tray 22, which adjoins the image forming unit 20, comprises a plate 60, a first guide plate 62 and a second guide plate 64. These plates 60, 62 and 64 are integrally formed. The plate 60 is used to receive the copied sheets P (not shown). The guide plates 62 and 64 are used to guide the printed sheets P in such a manner that the printed sheets P are temporarily held during the image forming process. A pair of exit rollers 66 are arranged at the inner end of the plate 60 so as to move each printed sheet P from the image forming unit 20 onto the plate 60. The rollers 66 are attached to the tray 22 so that they may be removed from the housing 12 when the tray 22 is pulled out of the housing 12.

A first distribution guide 68 is hinged between the aligning rollers 56 and the platen 48 so that it can change the course of the printed sheets P during the image forming operation, thereby to selectively guide those printed sheets P being moved from the aligning rollers 56 toward the platen 48 onto the first guide plate 62. A second distribution guide 70 is hinged between the exit rollers 66 and the platen 48 to selectively guide those printed sheets P being moved onto the second guide plate 64. As shown in FIG. 3, a sheet-bypass guide 72 is provided to guide other sheets (not shown) when the operator manually feeds them one by one into the apparatus. While sheets P are depicted in several of the Figures, none of the Figures depict manually-fed sheets inserted into bypass guide 72.

Figure 4:
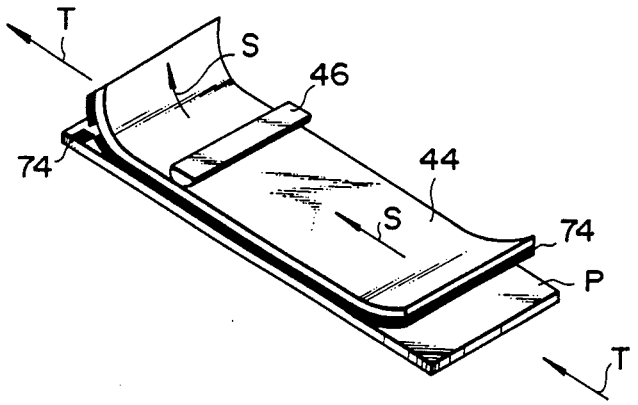
FIG. 4 is a perspective view for illustrating the transferring operation of the printer of FIG. 1.

The ink (color agent) 74 impregnated in the ribbon 44 is heated and melted by the thermal head 46 and thus is transferred to a sheet P as shown in FIG. 4. During this transfer of ink 74, the ribbon 44 and the sheet P are simultaneously moved in the directions of arrows S and T, respectively.

Figure 5:
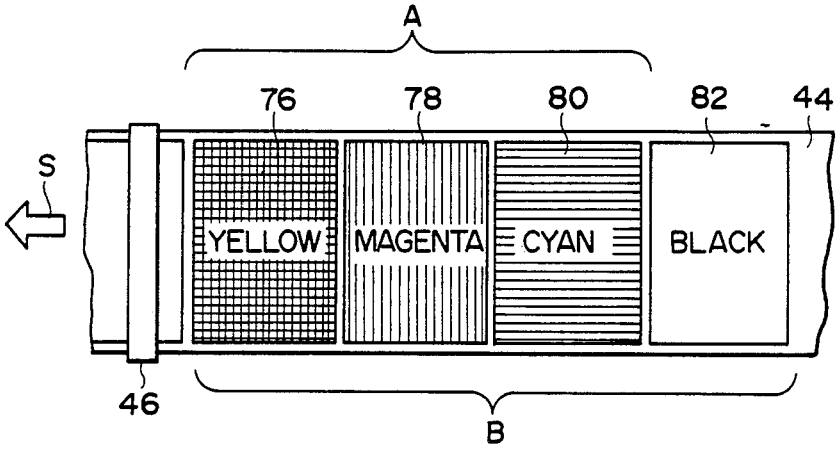
FIG. 5 is a plan view showing the way ink is applied to a ribbon used in the printer of FIG. 1.

As shown in FIG. 5, the ribbon 44 consists of unit lengths A. Each unit length A consists of a yellow-ink region 76, a magenta-ink region 78 and a cyan-ink region 80. Alternatively, the ribbon 44 may consist of unit lengths B each consisting of these ink regions 76, 78 and 80 and a black-ink region 82. The ink 74 is first transferred from one of the ink regions 76, 78, 80, 82 to the sheet P. Then, the sheet P is returned to its original position, and the ink 74 is transferred from another one of ink regions 76, 78, 80, 82 to the same portion of the sheet P. This process is repeated, tus transferring other inks 74 to the sheet P. As a result, the difference colored inks 74 are superposed, thereby providing a multi-color print. In general, an image is printed in black on the sheet P when yellow ink, magenta ink and cyan ink are transferred to the same portion of the sheet P. A deeper black image may be obtained by transferring the ink 74 from the black-ink region 82 to the sheet P.

The operation of the image forming unit 20 will now be described with reference to FIGS. 6 to 9.

Figure 6:
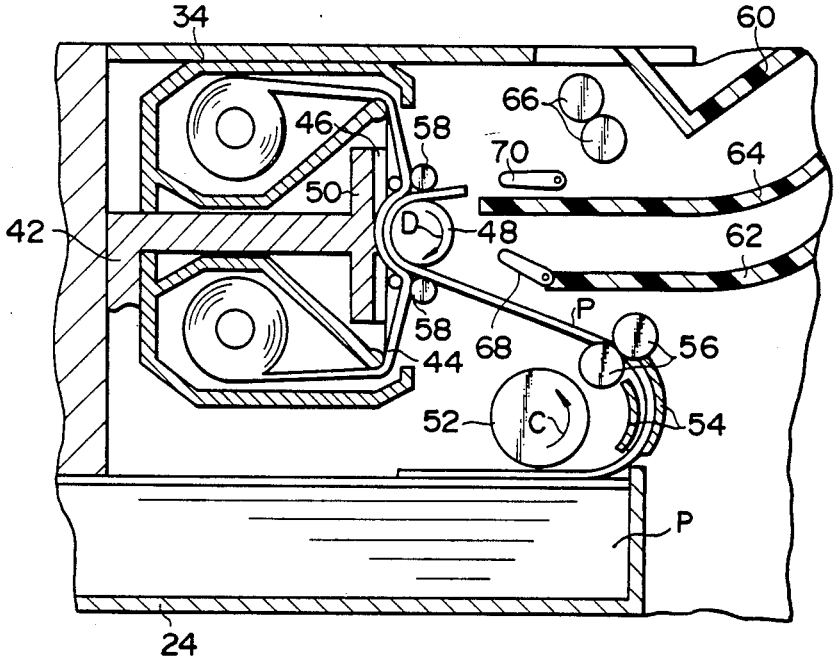
FIGS. 6 to 9 are sectional views for illustratuing the operation of the printer of FIG. 1.

When the roller 52 rotates in the direction of arrow C as shown in FIG. 6, a sheet P is taken from the cassette 24. The guide plates 54 guide the sheet P to the aligning rollers 56. The rollers 56 align the sheet P so that the front edge thereof is positioned parallel to the platen 48. The sheet P is conveyed to the platen 48. Since the platen 48 is rotated in the direction of arrow D, the sheet P moves until it comes to face the thermal head 46 across the ribbon 44. Then, the head 46 heats part of the ribbon 44 in accordance with the signals from the exposure system 18, thus transferring the first color ink 74 from the ribbon 44 to the sheet P.

Figure 7:
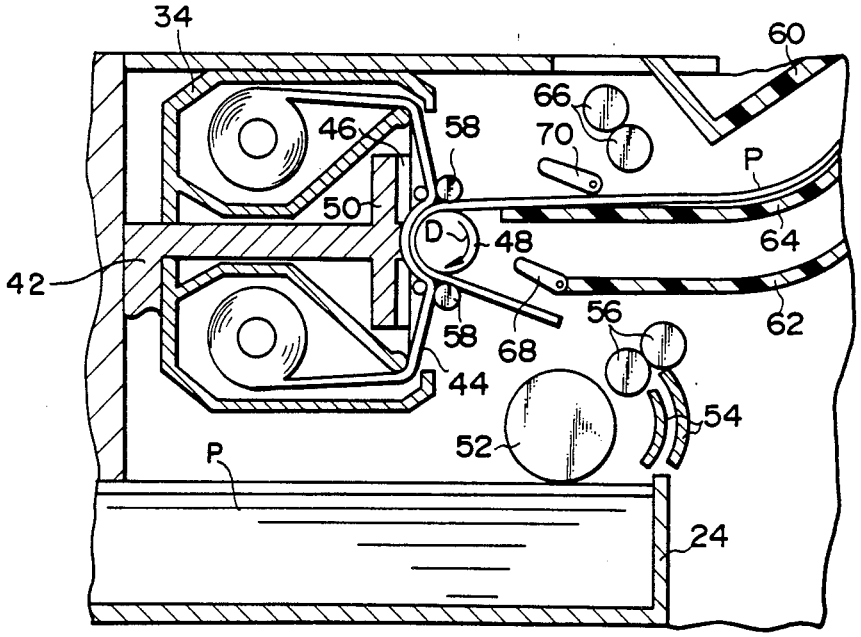

Then, as shown in FIG. 7, the second distribution guide 70 is lifted on. It guides the sheet P printed with the first color ink 74 to the plate 64. The sheet P is then temporarily held on the plate 64. Thereafter, the first distribution guide 68 rocks counterclockwise. It is lifted upward when the sheet P is about to leave the plate 64.

Figure 8:
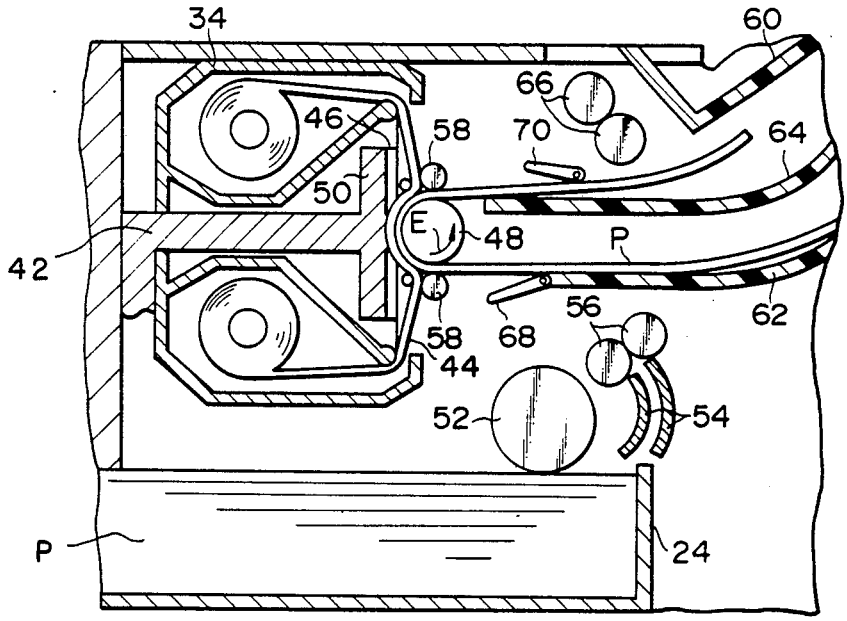

As shown in FIG. 8, the sheet P is further moved from the upper surface of the second guide plate 64 to the upper surface of the first guide plate 62. That is, it returns to and stays at the plate 62 for the second color ink printing. The platen 48 is rotated counterclockwise, i.e., in the direction of arrow E, thus moving the sheet P along the first guide plate 62. Since the first distribution guide 68 is lifted upward at this time, the sheet P moves smoothly along the upper surface of the plate 62.

Figure 9:
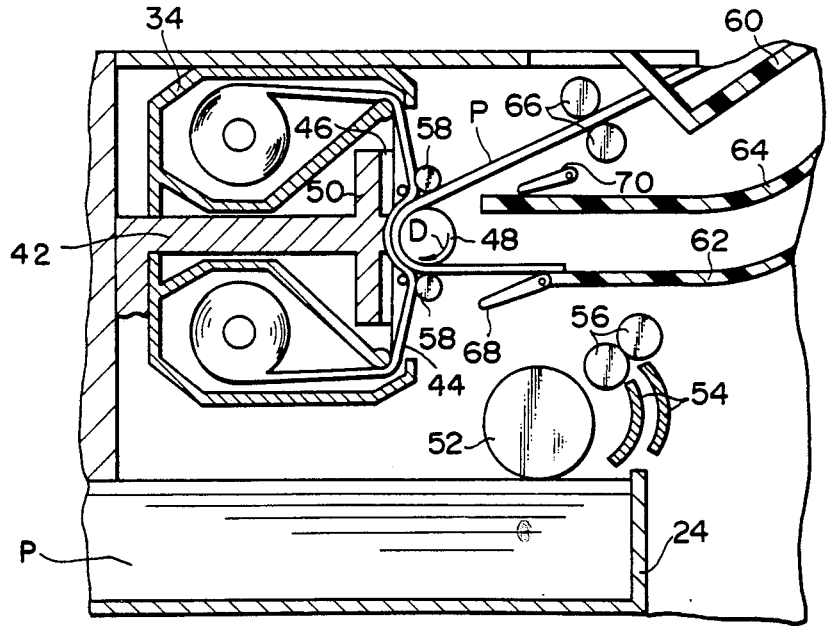

When the sheet P has been transferred to the upper surface of the first guide plate 62, the platen 48 is rotated in the direction of the arrow D as shown in FIG. 9, thus bringing the sheet P to the position where the sheet P faces the head 46. The second color ink 74 is thereby transferred from the ribbon 44 to the sheet P. Thereafter, a similar printing process is repeated, thus transferring the third color ink 74 and the fourth color ink 74 to the sheet P and forming a multi-color image. The second distribution guide 70 is down, whereby the sheet P is discharged from the image forming unit 20 and put on the plate 60 of the tray 22 when the image forming process is complete.

Figure 10:
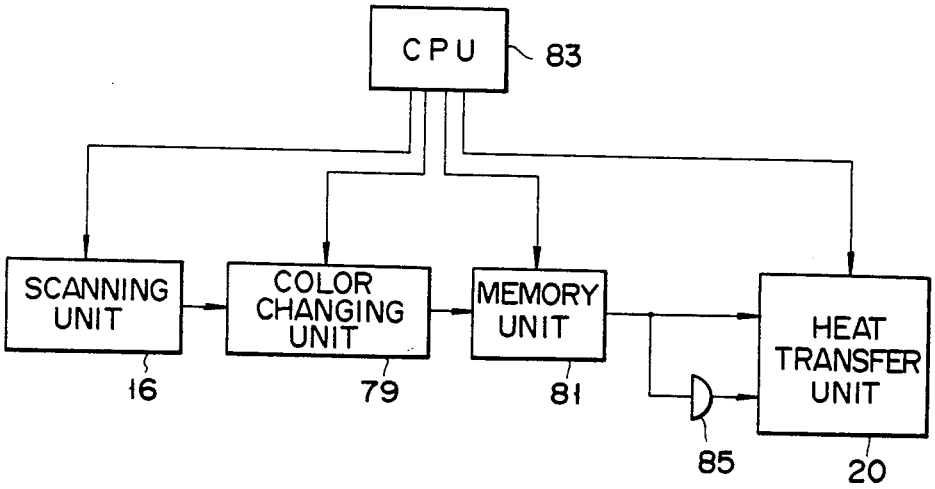
FIG. 10 is a block diagram showing the arrangement of the main part of the thermal printer shown in FIG. 1.

The apparatus is provided with a control system. As shown in FIG. 10, this system comprises a color changing unit 79 and a memory unit 81. The memory unit 81 is connected between the scanning unit 16 and the image forming unit 20. The color changing unit 79 is coupled to the unit 16. The scanning unit 16 generates data representing the positions of the components of the original multi-color image, as well as the signals showing the colors of these image components, i.e., green, yellow, cyan and black color signals. The color changing unit 79 receives the position data and the color signals from the unit 16, and converts the green, yellow, cyan and black color signals into signals designating yellow ink, magenta ink, cyan ink and black ink. The position data and the color signals are stored in the memory unit 81. To print the multi-color image on a sheet P, the position data and the color signals are read from the unit 81 and supplied to the image forming unit 20. The unit 20 transfers the respective inks 74 from the ribbon 44 to the sheet P in accordance with the color signals and the position data. As a result, the multi-color image is printed. An AND gate 85 is connected between the units 16 and 20. The gate 85 generates a black color signal when it receives the magenta-ink, yellow-ink and cyan-ink signals.

The scanning unit 16, the heat image forming unit 20, the color changing unit 79 and the memory unit 81 are connected to a CPU (central processing unit) 83. The CPU 83 controls the signal-generating timings of the units 16, 20, 79 and 83. It also controls the operations of these units 16, 20, 79, 83.

Figure 11:
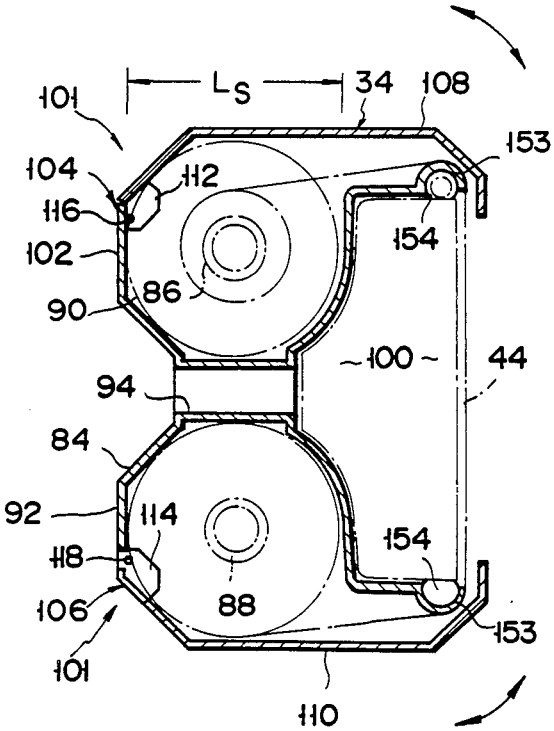
FIG. 11 is a sectional view of a ribbon cassette according to the embodiment of the present invention.
Figure 12:
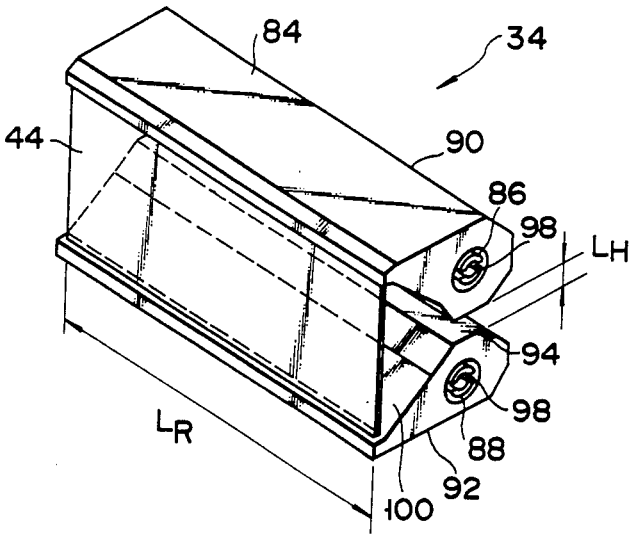
FIG. 12 is a perspective view of the ribbon cassette shown in FIG. 11.

Referring now to FIGS. 11 to 23, the ribbon cassette 34 will be described in detail. In the ribbon cassette 34, as shown in FIGS. 11 and 12, two substantially parallel roll shafts 86 and 88 wound individually with the two end portions of the ribbon 44 are arranged inside a case 84 (described later). The ribbon 44 is enclosed by the case 84 so as to be partially exposed.

Figure 13:
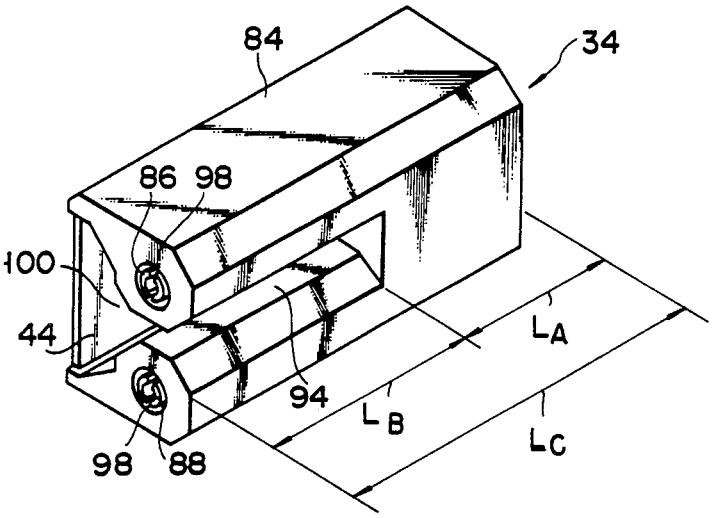
FIG. 13 is another perspective view of the ribbon cassette of FIG. 11 taken from another direction.

As shown in FIGS. 11 to 13, a slit 94 to receive the holder 42 is defined between case portions 90 and 92 which contain the roll shafts 86 and 88, respectively, and the ribbon 44 wound on the roll shafts 86 and 88. As shown in FIG. 13, the slit 94 extends along the extending direction of the roll shafts 86 and 88 and terminates in the middle of the case 84. A pair of notches 98 to connect with a drive mechanism 96 (mentioned later) are formed in the slit-side end portion of each of the roll shafts 86 and 88.

Figure 14:
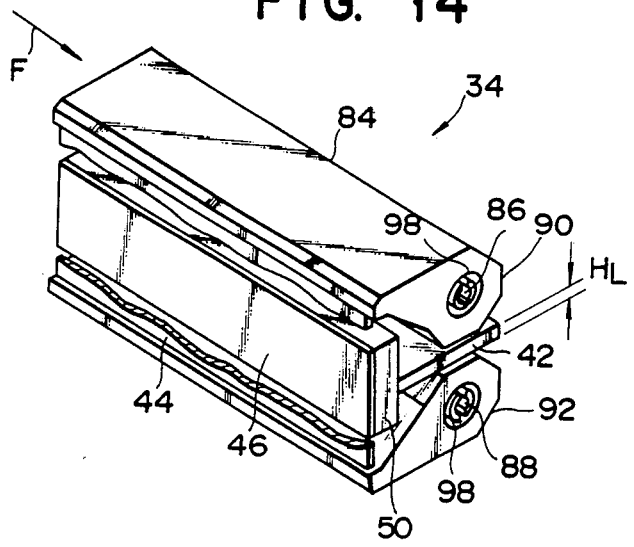
FIGS. 14 and 15 are perspective views for illustrating how the ribbon cassette of FIG. 13 is set in place.
Figure 15:
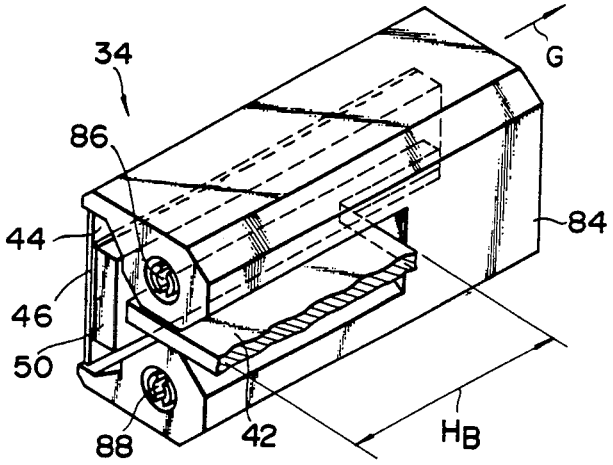

In the ribbon cassette 34, moreover, a space 100 capable of receiving the thermal head 46 is defined between the exposed portion of the ribbon 44 and the case portions 90 and 92. As shown in FIGS. 12 and 13, the space 100 extends along the extending direction of the roll shafts 86 and 88. With this arrangement, as shown in FIGS. 14 and 15, the ribbon cassette 34 is pushed in the direction of arrow F against the holder 42 and the thermal head 46 when it is inserted into the housing 12. When the ribbon cassette 34 is removed from the housing 12, it is drawn out in the direction of arrow G.

The dimensions of the ribbon cassette 34 are as follows. In FIGS. 11 to 15, the width of the ribbon 44 is indicated by $L_R$ (FIG. 12); the maximum ribbon roll diameter is indicated by $L_S$ (FIG. 11); the slit width is indicated by $L_B$ (FIG. 13); the slit height is indicated by $L_H$ (FIG. 12); the overall ribbon cassette length is indicated by $L_C$ (FIG. 13); the width of slitless portion of ribbon cassette 34 is indicated by $L_A$ (FIG. 13); the holder thickness is indicated by $H_L$ (FIG. 14); and the holder width is indicated by $H_B$ (FIG. 15). Hereupon, there is given a relation $L_B > \frac{1}{2}L_C$. In this embodiment, $L_C$ and $L_B$ are set to be 250 mm and approximately 160 mm, respectively. Thus, the width $L_B$ of the slit 94 to receive the holder 42 is greater than one-half of the overall length $L_C$ of the ribbon cassette 34, so that the holder 42 can securely hold the ribbon cassette 34 over a long range when the ribbon cassette 34 is set in the housing 12.

Since the transverse supporting strength of the thermal head 46 depends on the width $H_B$ (approximately 160 mm in this embodiment) of the holder 42, the slit 94 is formed in a manner such that $L_B$ (approximately 160 mm) is greater than $L_A$ (approximately 90 mm).

The slit height $L_H$ is a little greater than the holder thickness $H_L$ (approximately 10 mm in this embodiment), while the slit width $L_B$ is substantially equal to the holder width $H_B$ (approximately 160 mm). Thus, in loading the housing 12 with the ribbon cassette 34, no play or backlash will be produced between the holder 42 and the case 84 of the ribbon cassette 34.

The construction of the case 84 of the ribbon cassette 34 will be described with reference to FIGS. 16 to 23. The case 84 comprises a frame 102, a common side plate 103 and separate side plates 105 and 107 which support the ends of the roll shafts 86 and 88, and a lid means 101 (referred to in FIG. 21). A grip 109 is formed on the common side plate 103 to allow the operator to hold the ribbon cassette 34.

The lid means 101 is opened/closed to replace the ribbon 44 with respect to the case 84 as needed. The lid means 101 comprises a pair of covers 108 and 110 which can be pivoted upward and downward with respect to the frame 102 through corresponding hinges 104 and 106. The hinges 104 and 106 comprise plates 112 and 114 fixed on the covers 108 and 110, and support pins 116 and 118 for pivotally supporting the plates 112 and 114, respectively. Therefore, the covers 108 and 110 can be pivoted about the support pins 116 and 118, respectively.

The pair of roll shafts 86 and 88 are detachably mounted by a holding means (or slot means) 89 in the case 84, as shown in FIGS. 16 to 18 and FIG. 22.

Figure 17:
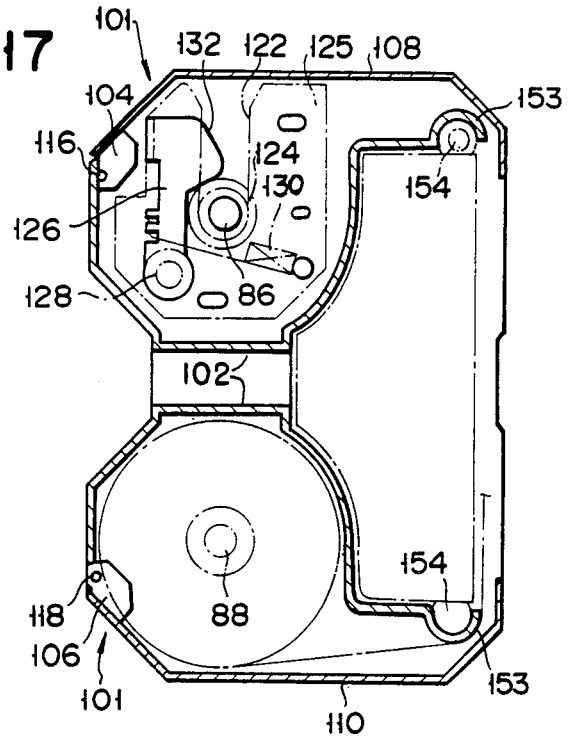
FIG. 17 is a cross-sectional view of a roll shaft holding mechanism mounted in the ribbon cassette shown in FIG. 11.
Figure 18:
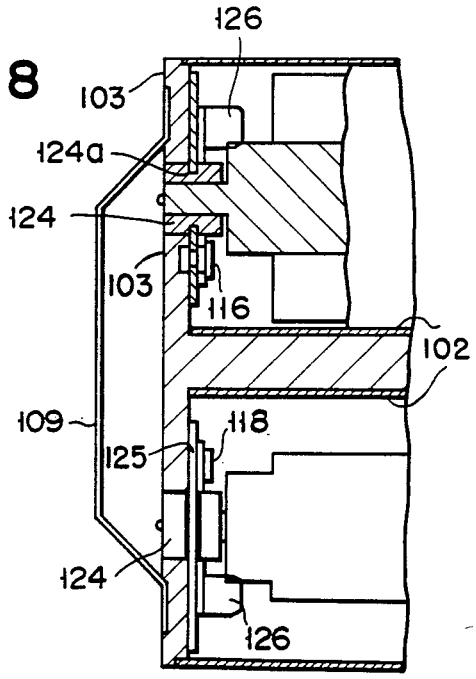
FIG. 18 is a cross-sectional view showing part of the ribbon cassette of FIG. 16.

U-shaped grooves 122 are formed on the upper and lower portions of the common side plate 103. One end (an end opposing the drive end) of each of the roll shafts 86 and 88 is rotatably supported by one of the corresponding U-shaped grooves 122 through a corresponding bushing 124. Circumferential grooves 124*a* are formed on the outer surfaces of the bushings 124. Plates 125 fixed on the inner side of the common plate 103 are fitted in the grooves 124*a*. Holding levers 126 (only one holding lever 126 is illustrated in FIG. 17) as holding means for holding the roll shafts 86 and 88 are rotatably supported at the upper and lower portions of the inner side (bushing side) of the common side plate 103 through support pins 128. As shown in FIG. 17, a hook 132 at the distal end of each of these holding levers 126 is biased by a spring 130 to stop one of the corresponding bushings 124 of the roll shafts 86 and 88.

Figure 21:
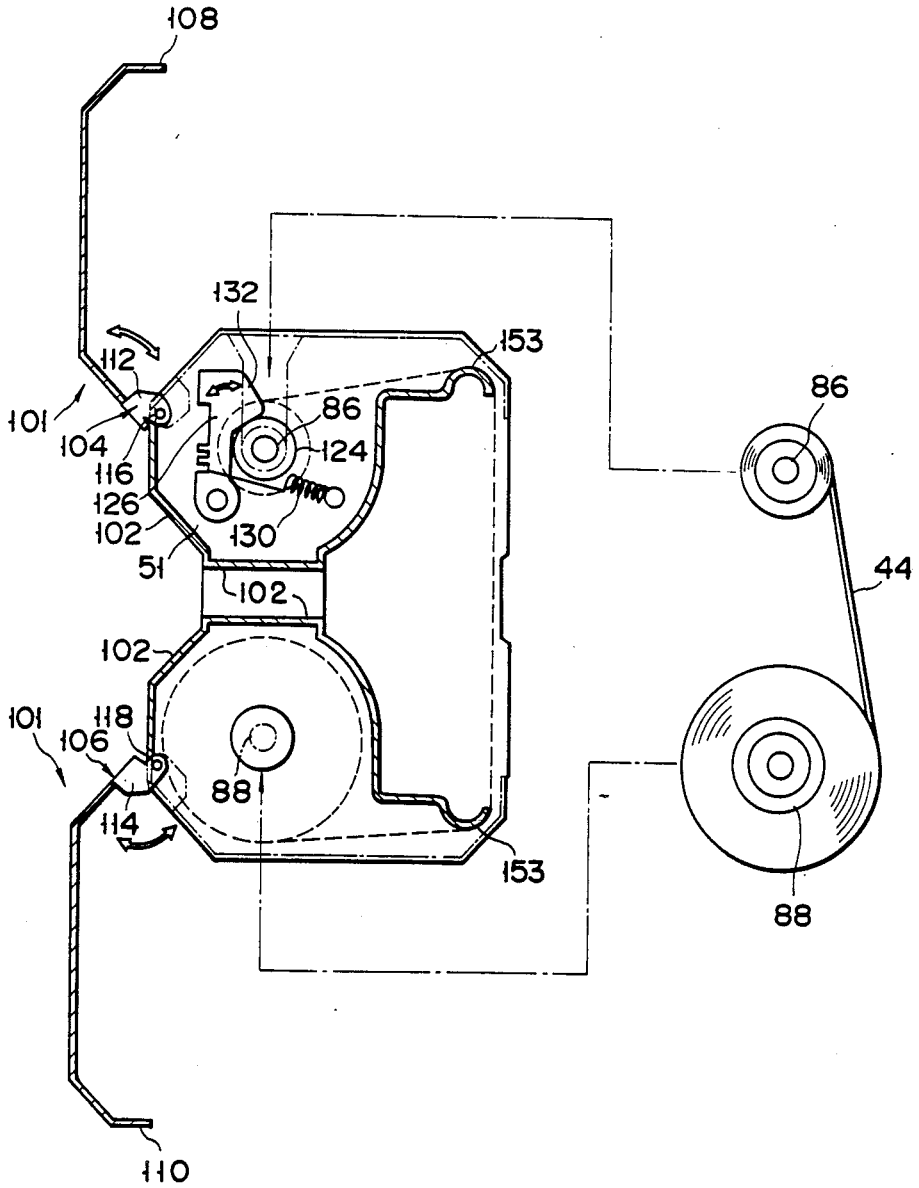
FIG. 21 is a cross-sectional view for explaining a method of setting the ribbon in the ribbon cassette of FIG. 11.
Figure 22:
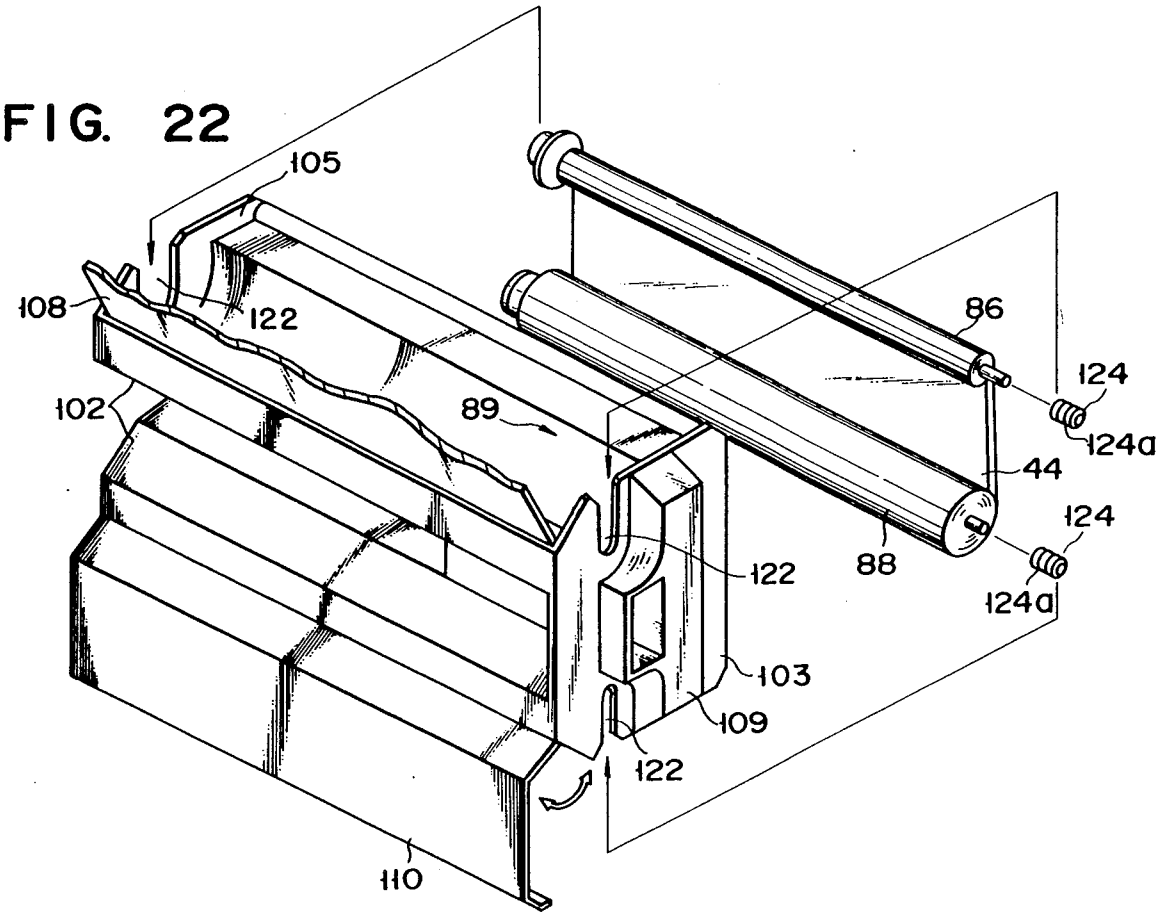
FIG. 22 is an exploded perspective view of the ribbon cassette shown in FIG. 11.
Figure 23:
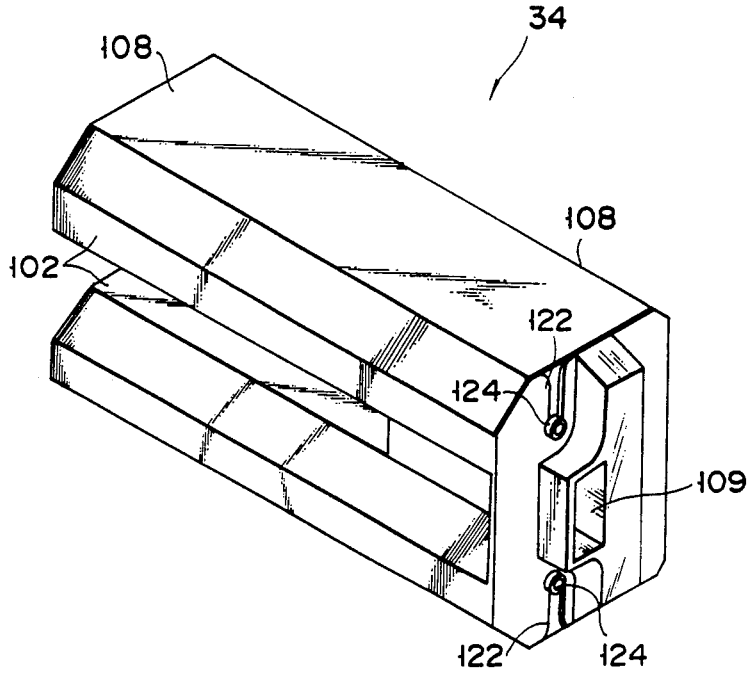
FIG. 23 is a perspective view showing the assembled state of the ribbon cassette of FIG. 22.

When the ribbon cassette 34 is removed from the housing 12 of the printer 10, as shown in FIG. 21, the covers 108 and 110 of the case 84 are opened, and the holding levers 126 are rotated counterclockwise against the biasing force of the spring 130, thereby freeing the pair of roll shafts 86 and 88 from the side plate 103 and hence enabling them to be removed from the case 84.

Conversely, when the pair of roll shafts 86 and 88, having a new ribbon 44 are to be set in the case 84, the bushings 124 on the shafts 86, 88 are inserted in the U-shaped grooves 122, and the holding levers 126 are stopped by the hooks 132. Thereafter, the covers 108 and 110 are closed to complete the setting of the roll shafts 86 and 88.

The roll shafts 86 and 88 can be mounted in or detached from the case 84 in the manner described above. Even when the thermal transfer ribbon 44 is jammed or cut, only the roll shafts 86 and 88 and the ribbon 44 are replaced with new ones, and the case 84 can be reused.

Figure 16:
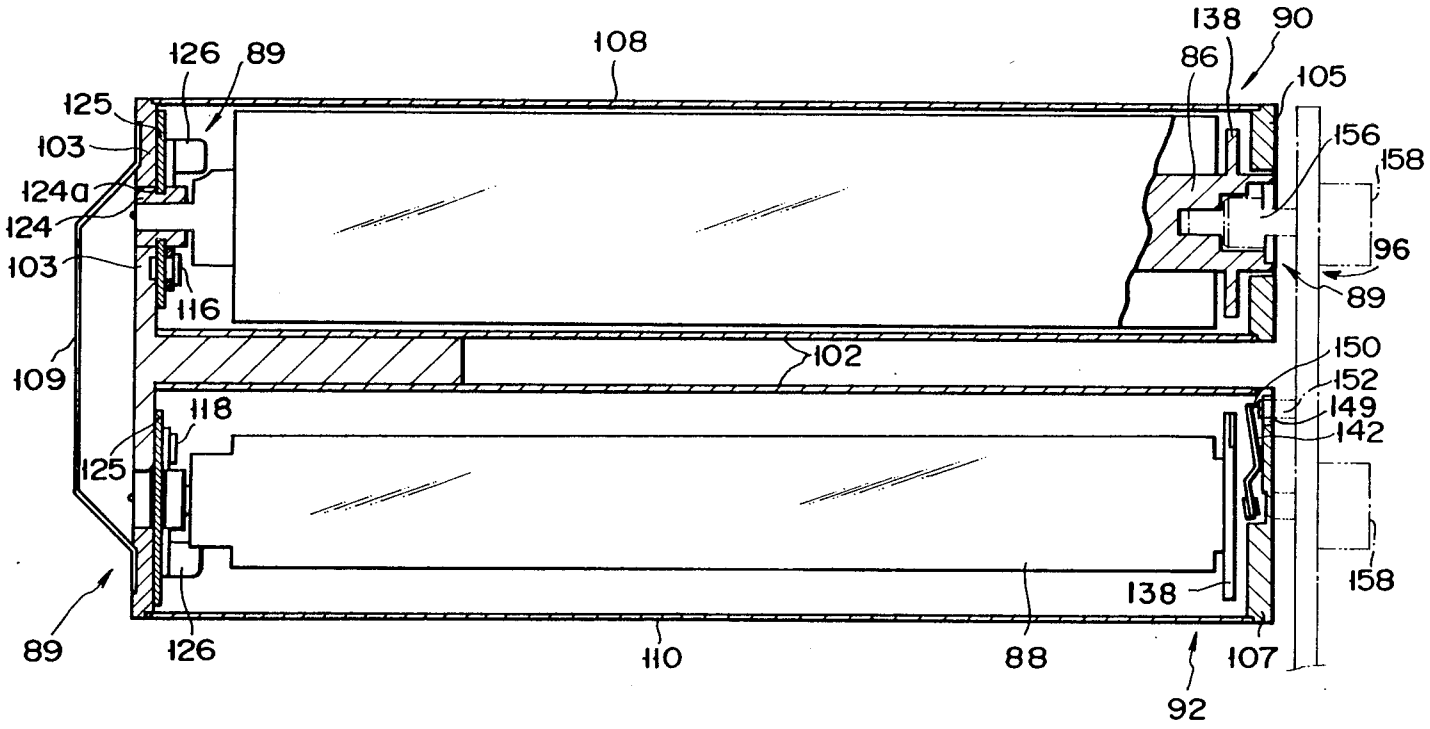
FIG. 16 is a longitudinal sectional view of the ribbon cassette shown in FIG. 11.
Figure 20:
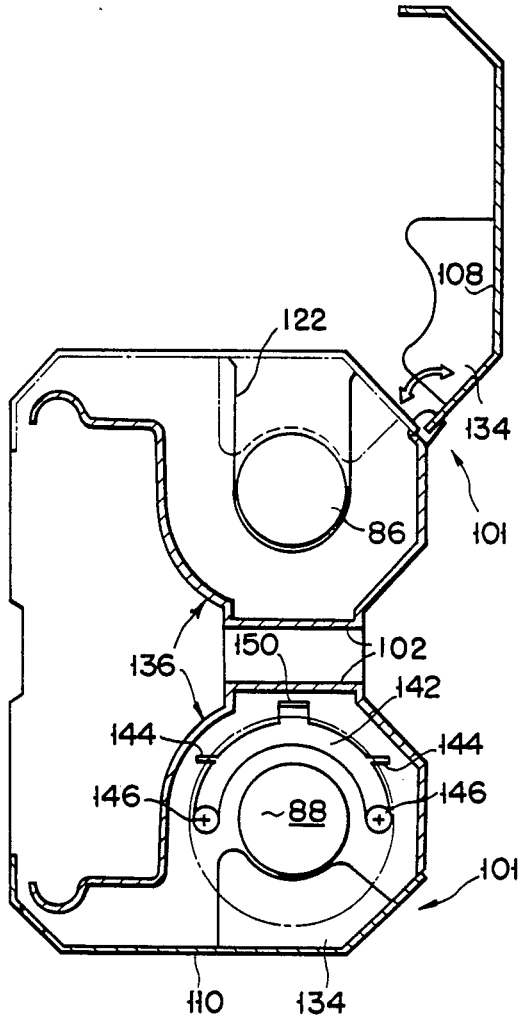
FIG. 20 is a side view of the roll shaft lock mechanism shown in FIG. 19.
Figure 19:
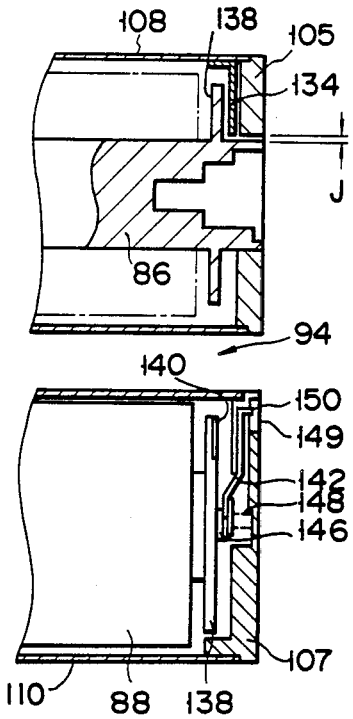
FIG. 19 is a cross-sectional view of a roll shaft lock mechanism of the ribbon cassette shown in FIG. 16.

At the ends (drive ends to be coupled to the drive mechanism 96) of the side plates 105 and 107 of the case 84, as shown in FIGS. 16, 19 and 20, hold plates 134 are mounted in the covers 108 and 110 to hold the roll shafts 86 and 88 set in U-shaped grooves 122 formed in the side plates 103 and 105. The hold plates 134 are provided corresponding to the side plates 105 and 107. When the covers 108 and 110 are closed, each of the hold plates 134 cooperates with one of the corresponding U-shaped grooves 122 of the side plates 105 and 107 to surround and hold the other end (the end opposite to the grip side) of each of the roll shafts 86 and 88. In this case, as indicated by reference symbol J in FIG. 19, gaps are formed between the roll shafts 86 and 88 and the hold plates 134, thereby allowing slight movement of the roll shafts 86 and 88. Therefore, the drive mechanism 96 can be easily coupled to the roll shafts 86 and 88.

As shown in FIGS. 19 and 20, lock mechanisms 136 are coupled to the drive ends (slit side) of the roll shafts 86 and 88 to hold the roll shafts 86 and 88 when they are not loaded in the printer 10. The lock mechanisms 136 comprise flanges 138 which are fixed on the roll shafts 86 and 88 and rotated together therewith. Pads 140 such as rubber members having a high friction coefficient are mounted on the flanges 138. An arcuate lock lever 142 is provided in the lock mechanism 136 at the inner surface of each side plate 105 or 107 of the case 84 so as to apply a braking force to the corresponding flange 138. Pivot portions 144 are formed on the lock levers 142 to rotatably support them. Pads 146 (e.g., a rubber member having a high friction coefficient) are adhered to the two ends (below the pivot portions 144) of each lock lever 142 where the pads 146 are to abut against the pads 140 of the corresponding flange 138. A spring 148 is arranged at a position corresponding to the lower surface of each pad 146 between the side plates 105 and 107 and the lock lever 142, thereby always biasing the pad 146 toward the flange 138. A projection 150 is formed at the center of each arcuate lock lever 142. A hole 149 is formed in each side plate 105 or 107 at a position corresponding to the projection 150. When the cassette 34 is mounted in the printer 10, each projection 150 is pressed by a release portion 152 (FIG. 16) through the hole 149. The release portion 152 projects onto the holder 42.

When the ribbon cassette 34 is unloaded from the housing 12, the pads 146 of the lock lever 142 are brought into tight contact with the pads 140 of the flanges 138 to lock the pair of roll shafts 86 and 88, thereby preventing rotation of the roll shafts 86 and 88. When the ribbon cassette 34 is transported, the ribbon 44 can be kept taut.

As shown in FIG. 16, when the ribbon cassette 34 is loaded into the housing 12, the release portions 152 urge the projections 150 of the lock levers 142 to pivot the lock levers 142 about the pivot portions 144 in order to separate the pads 146 from the pads 140 of the flanges 138. In this state, the roll shafts 86 and 88 can be freely rotated. As shown in FIGS. 11, 17 and 21, arcuate ribbon guides 153 are formed in the case 84 to guide the ribbon 44 to a ribbon exposed section of the case 84. The inner surfaces of the ribbon guides 153 are engaged with cassette guides 154 mounted in the holder 42 when the cassette 34 is loaded in the holder 42. The cassette guides 154 extend horizontally along the loading direction of the cassette 34 to be parallel to each other in the vertical direction.

High precision and strength are required for the ribbon guides 153 to accurately feed the ribbon 44. The strength of the ribbon guides 153 is reinforced by the cassette guides 154. For this reason, the distance between the upper and lower ribbon guides 153 is smaller than that between the cassette guides 154 so as to cause the upper and lower ribbon guides 153 to slightly clamp the cassette guides 154 in the vertical direction.

Figure 24:
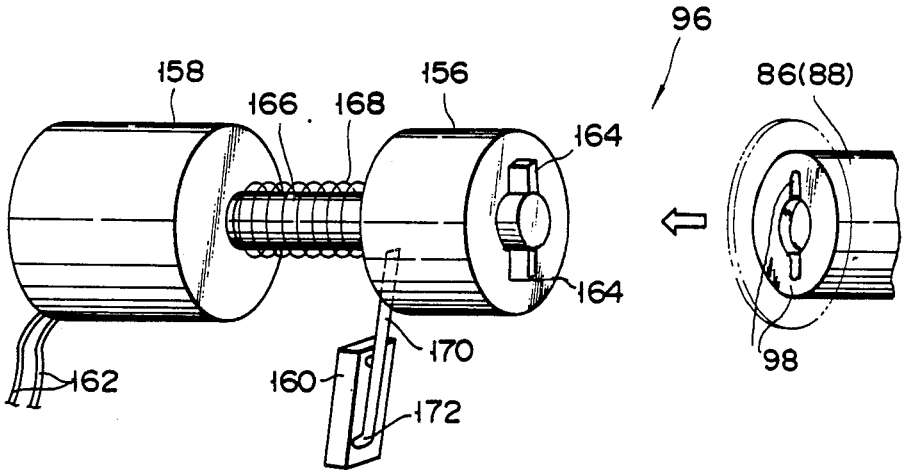
FIG. 24 is a perspective view showing a drive mechanism for driving the roll shafts in the ribbon cassette of FIG. 11.

Referring now to FIG. 24, there will be described the drive mechanism 96 for feeding or rewinding the ribbon 44 rolled in the ribbon cassette 34. The drive mechanism 96 is provided with a coupling 156 to engage the notches 98 of the roll shaft 86 or 88 and a motor 158 for supplying power to the coupling 156. The motor 158 is connected to a switch 160 and a power source (not shown) by means of cords 162. The coupling 156 has projections 164 which engage the pair of notches 98. The pair of projections 164 are diametrically opposed to each other to correspond with the notches 98. The coupling 156 is connected to a drive shaft 166 of the motor 158 so as to be movable along the drive shaft 166. A spring 168, which is wound around the drive shaft 166 so as to extend along the same, urges the coupling 156 so that the coupling 156 is kept away from the motor 158. A lever 170 is fixed to the coupling 156, whereby the switch 160 for starting the motor 158 is turned on. A claw 172 for depressing the switch 160 is formed at the extreme end of the lever 170. The switch 160 is turned on to start the motor 158 when it is depressed by the claw 172. When the claw 172 is disengaged from the switch 160, the switch 160 is turned off to stop the motor 158.

In the drive mechanism 96 constructed in this manner, if the notches 98 of the roll shaft 86 (88) and the projections 164 are not engaged when the ribbon cassette 34 is set in the housing 12, the projections 164 are pressed against the end portion of the roll shaft 86, 88, so that the coupling 156 is moved toward the motor 158 against the urging force of the spring 168. Then, the lever 170 presses the switch 160 to turn it on, so that the drive shaft 166 of the motor 158 starts to rotate. As the drive shaft 166 rotates, the projections 164 shift their positions to be allowed to engage their corresponding notches 98. When the projections 164 engage the notches 98, the coupling 156 is moved by the urging force of the spring 168, so that the claw 172 of the lever 170 leaves the switch 160 to turn if off. When the switch 160 is off, it is separated from the claw 172 of the lever 170. During the normal drive of the motor 158, therefore, the switch 160 will never run against the claw 172, that is, it will not prevent the rotation of the coupling 156.

Figure 25:
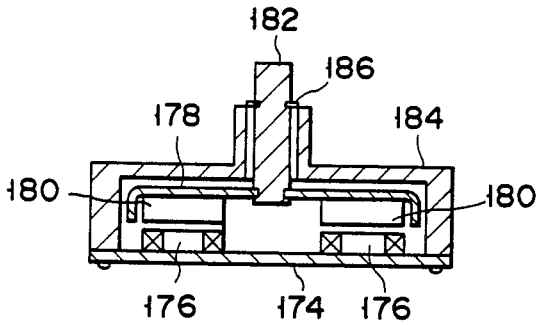
FIG. 25 is a schematic sectional view of a motor shown in FIG. 24.
Figure 26:
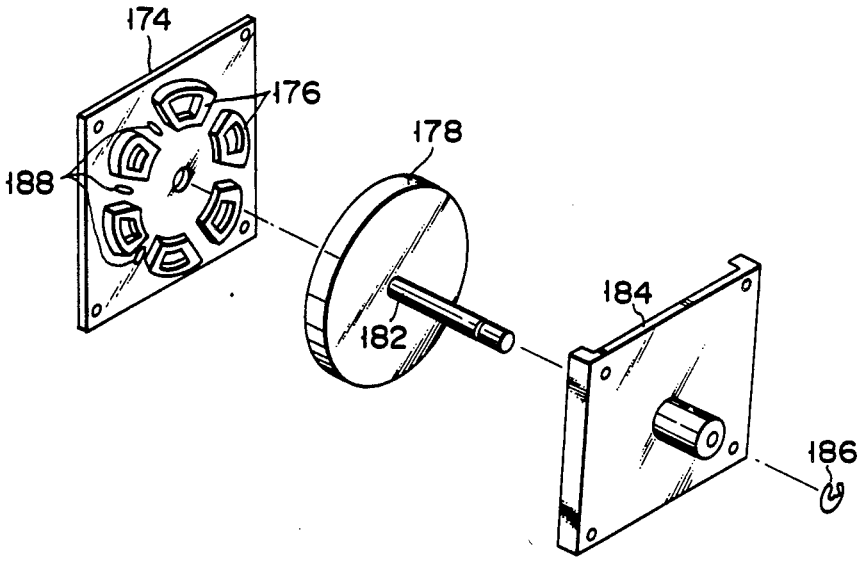
FIG. 26 is an exploded perspective view of the motor of FIG. 25.
Figure 27:
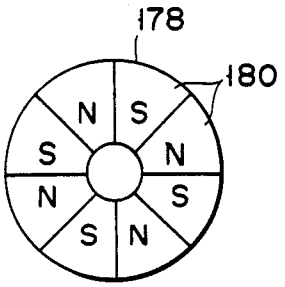
FIG. 27 is a representation showing a magnetic pole state of a rotor of FIG. 25.

The ribbon drive motor 158 will be described. The motor 158 is a DC (direct current) brushless motor, as shown in FIGS. 25 to 27. Six trapezoidal coils 176 are arranged on a printed circuit board 174 at equal angular intervals. A rotor 178 is arranged to oppose the coils 176. As shown in FIG. 27, a permanent magnet 180 is arranged on a portion of the rotor 178 which opposes the coils 176. A shaft 182 of the rotor 178 extends through a motor case 184 mounted on the printed circuit board 174 and is rotatably mounted through an E-ring 186. Three Hall elements 188 are arranged between selected adjacent coils 176. The Hall elements 188 detect the position of the permanent magnet 180 of the rotor 178. A detection signal from the Hall element 188 is utilized as a phase switching timing signal.

Figure 28:
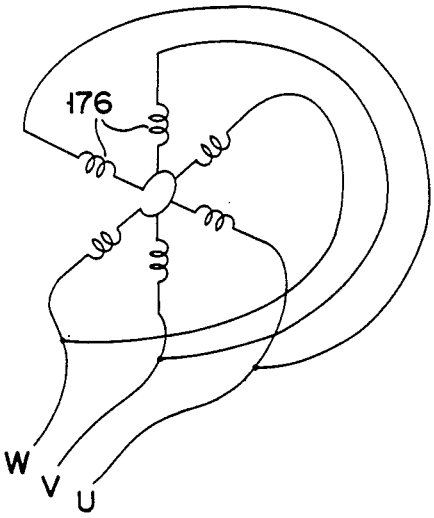
FIG. 28 is a diagram showing an equivalent circuit of the motor of FIG. 25.
Figure 29:
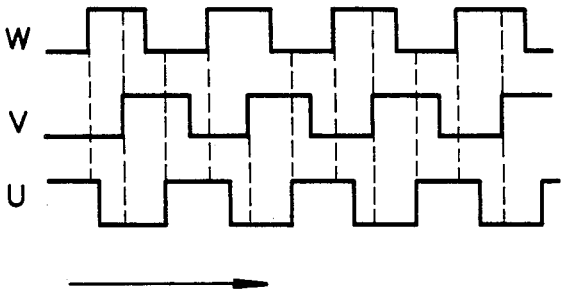
FIG. 29 is a timing chart of a motor drive signals for the motor of FIG. 25.

With this construction, the coils 176 are wired in the manner as shown in FIG. 28. By supplying timing signals (FIG. 29) to terminals U, V and W, a mutual effect between the magnetic force generated from the coils 176 and the magnetic force generated by the permanent magnet 180 of the rotor 178 causes rotation of the motor 158.

Other embodiments of the present invention will be described hereinafter. The same reference numerals as in the subsequent embodiment denote the same parts as in the first embodiment.

Figure 30:
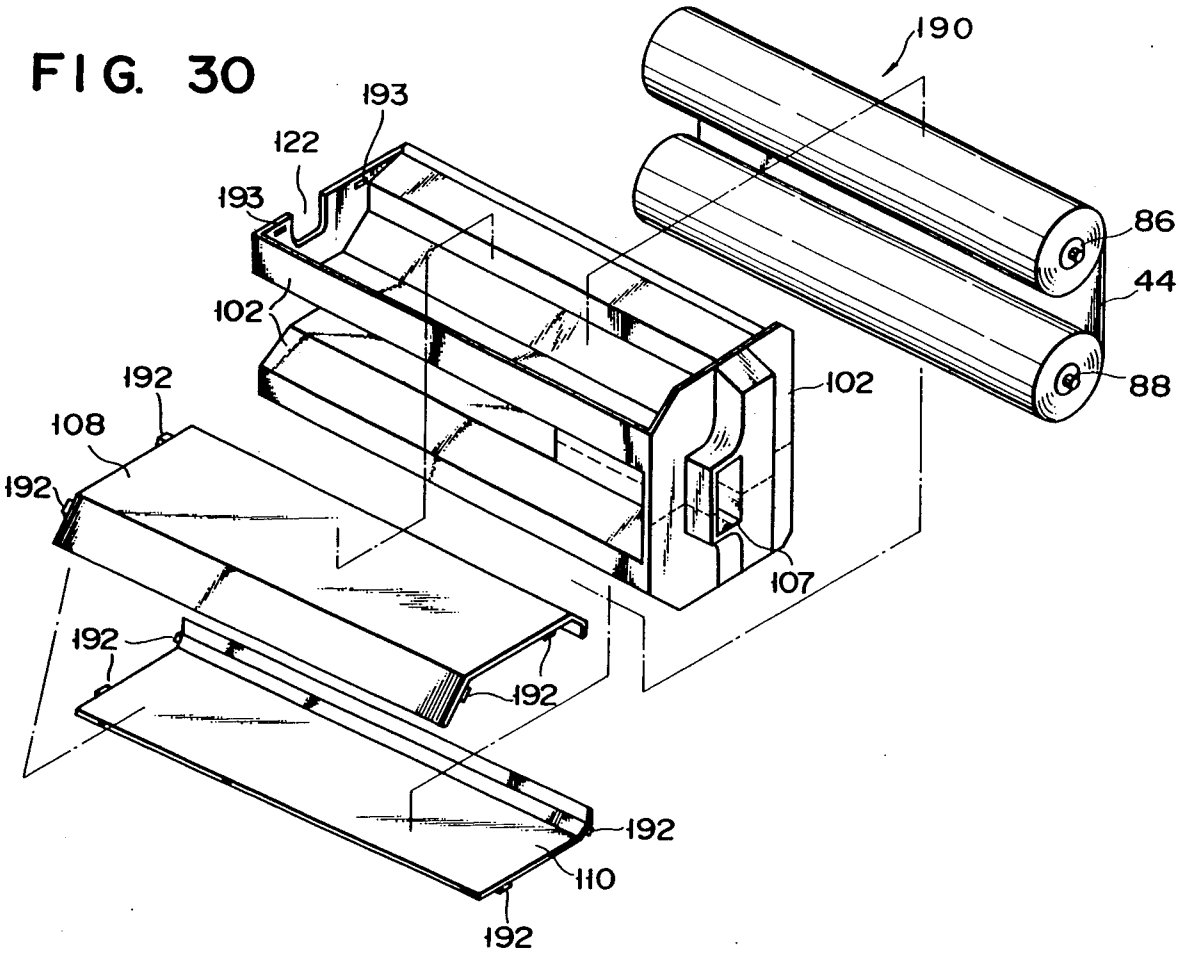
FIG. 30 is an exploded perspective view of a ribbon cassette according to a second embodiment of the present invention.

In a ribbon cassette 190 according to a second embodiment of the present invention, as shown in FIG. 30, covers 108 and 110 are detachably mounted on a frame 102. In this case, pawls 192 as engaging means are formed in the covers 108 and 110 to engage with recesses 193 of the frame 102. According to the second embodiment, unlike the first embodiment, hinges 104 and 106 need not be used.

A third embodiment of the present invention will be described with reference to FIGS. 31 to 37. In a ribbon cassette 194 in this embodiment, an upper case portion 90 for storing a roll shaft 86 and a lower case porton 92 for storing a roll shaft 88, are separate units. In the ribbon cassette 194 in the third embodiment, covers 108 and 110 are detachably mounted on the frame 102 in the same manner as in the second embodiment.

Figure 32:
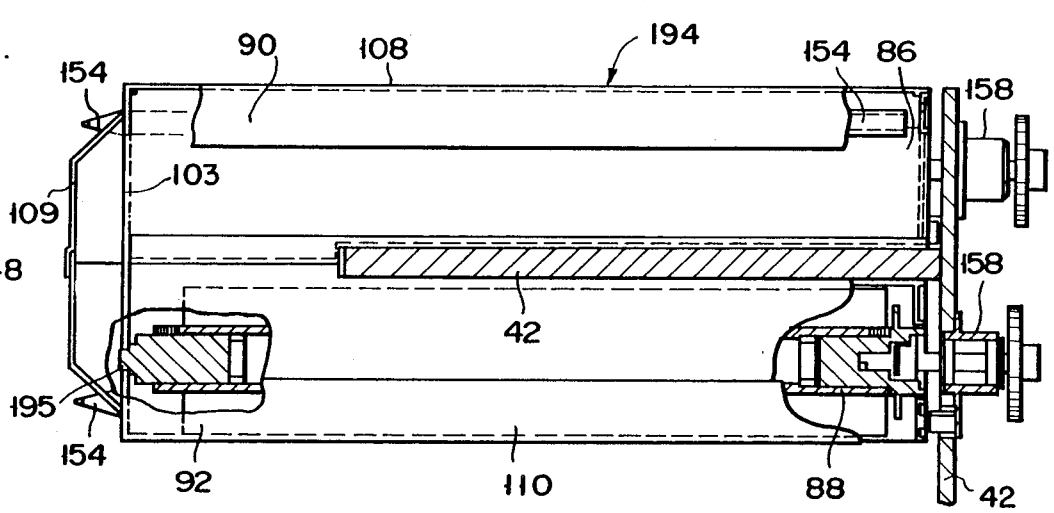
FIG. 32 is a partially cutaway front view of the ribbon cassette shown in FIG. 31.
Figure 31:
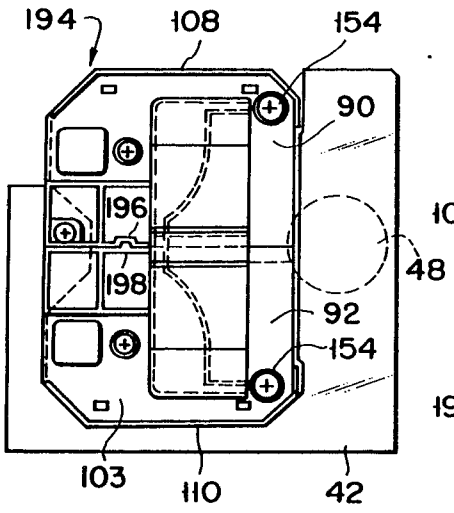
FIG. 31 is a side view of a ribbon cassette according to a third embodiment of the present invention.
Figure 34:
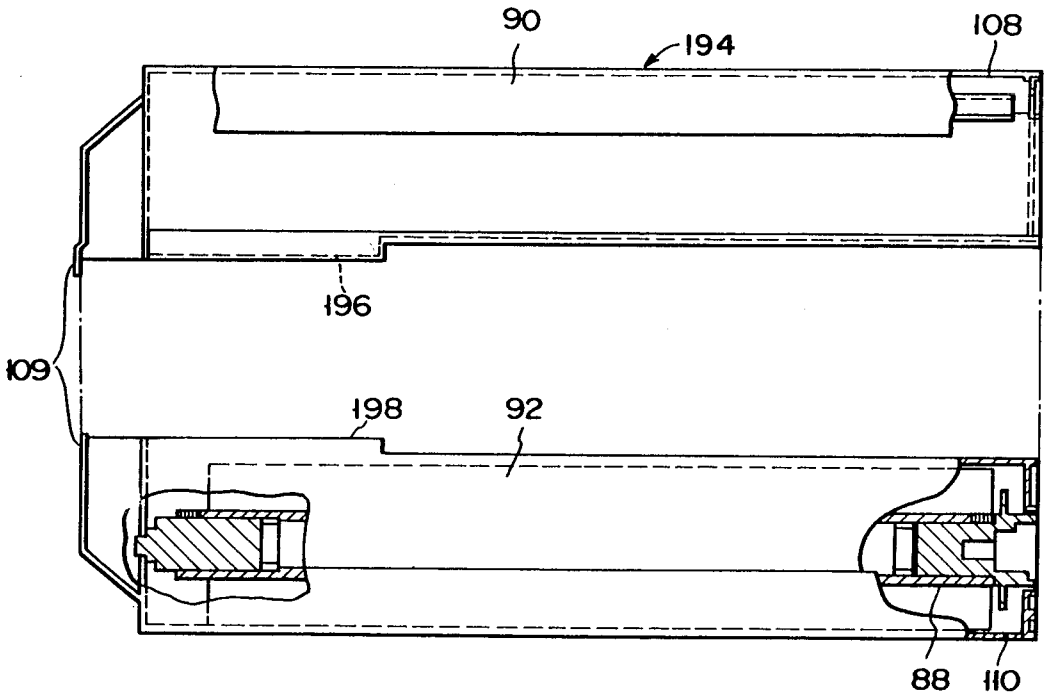
FIG. 34 is a partially cutaway front view showing the divided state of the ribbon cassette of FIG. 31.
Figure 35:
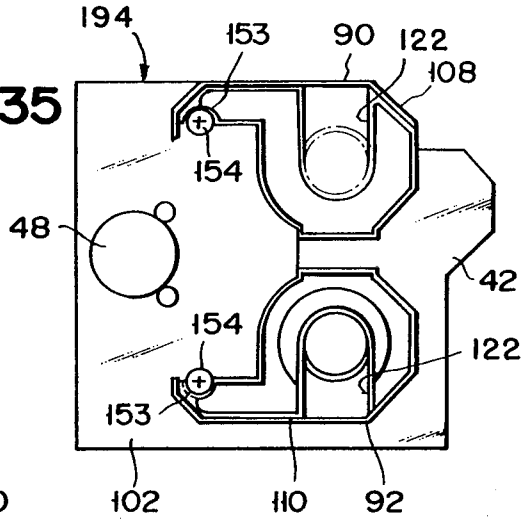
FIG. 35 is a schematic view showing a state wherein the ribbon cassette of FIG. 31 is held in a holder.
Figure 36:
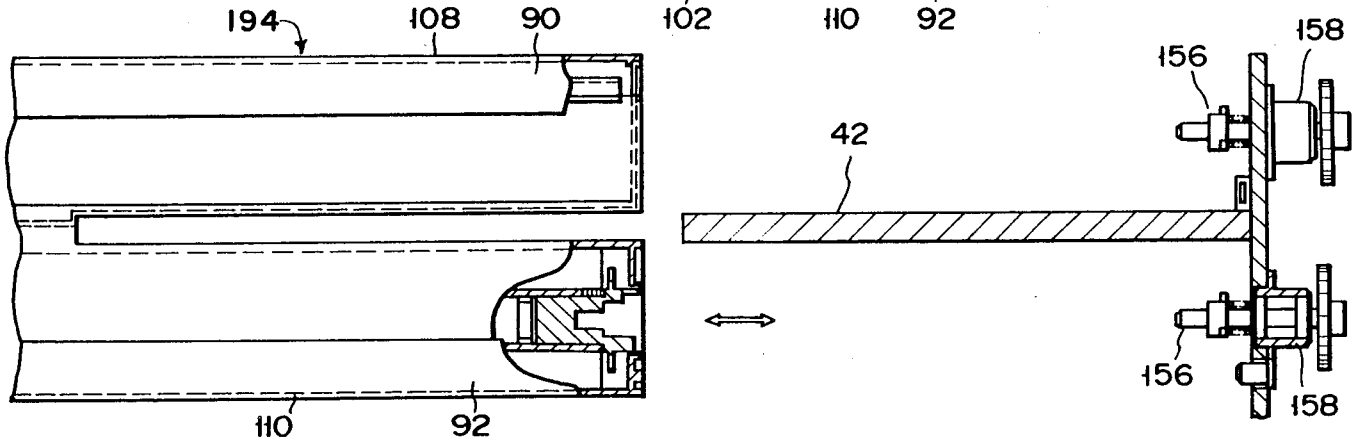
FIG. 36 is a schematic view showing a state wherein the ribbon cassette of FIG. 31 is held in the holder.
Figure 37:
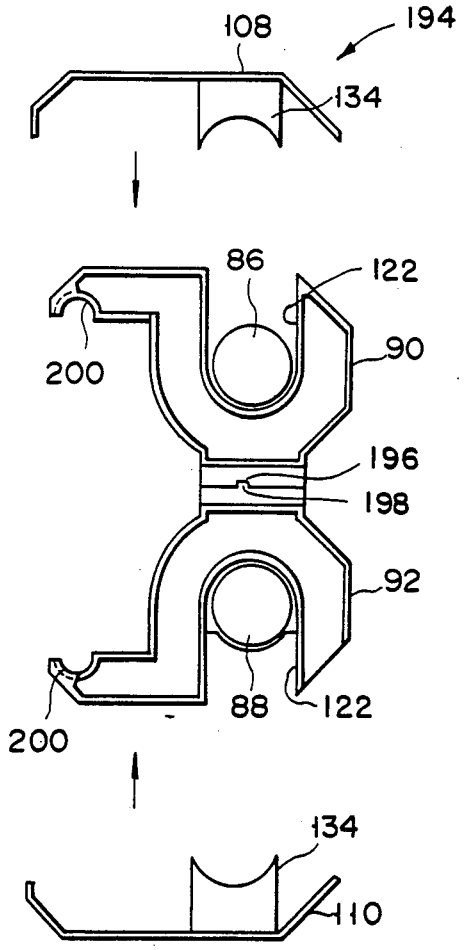
FIG. 37 is a schematic view showing a state wherein a ribbon cassette cover of FIG. 31 is mounted.

As shown in FIG. 32, the roll shafts 86 and 88 are detachably set in the separate upper and lower case portions 90 and 92, respectively. One end (the end at the grip 109 side) of each of the roll shafts 86 and 88 is directly fitted into a hole 195 formed in a side plate 103. One end is rotatably supported by the side plate 103. The other end (the drive end) of each of the roll shafts 86 and 88 is disposed to provide a gap by means of a corresponding one of U-shaped grooves 122 formed in side plates 105 and 107 and a corresponding one of hold plates 134 formed in covers 108 and 110 in the same manner as in the first embodiment, as shown in FIGS. 35 and 37. More specifically, the drive side (the side coupled to a drive mechaniam 96) of the roll shafts 86 and 88 is subjected to slight movement with respect to a case 84. Therefore, a drive coupling (of a DC motor 158) can be easily set.

Figure 33:
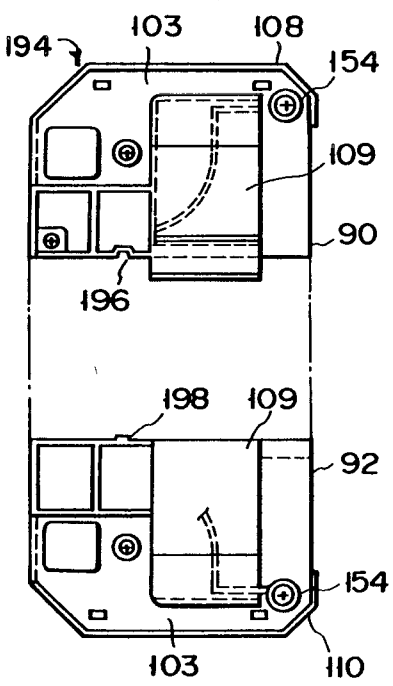
FIG. 33 is a side view showing a divided state of the ribbon cassette of FIG. 31.

As shown in FIG. 33, a recess 196 is formed at the lower portion of the upper case portion 90, and a projection 198 is formed on the upper portion of the lower case portion 92 to be fitted in the recess 196. With this construction, the upper and lower case portions 90 and 92 can be aligned with each other since the projection 198 is fitted in the recess 196. Thereafter, the upper and lower case portions 90 and 92 are fixed together, for example, by an adhesive or screws (not shown). As shown in FIG. 32, a grip 109 of the ribbon cassette 194 is formed upon assembly of the ribbon cassette 194.

As shown in FIG. 37, upper and lower covers 108 and 110 are detachably mounted on the upper and lower case portions 90 and 92. The pair of roll shafts 86 and 88 are loaded in the upper and lower case portions 90 and 92 while the upper and lower covers 108 and 110 are detached. When the upper and lower covers 108 and 110 are mounted on the corresponding case portions, the roll shafts 86 and 88 are held in the upper and lower case portions 90 and 92, respectively.

Figure 38:
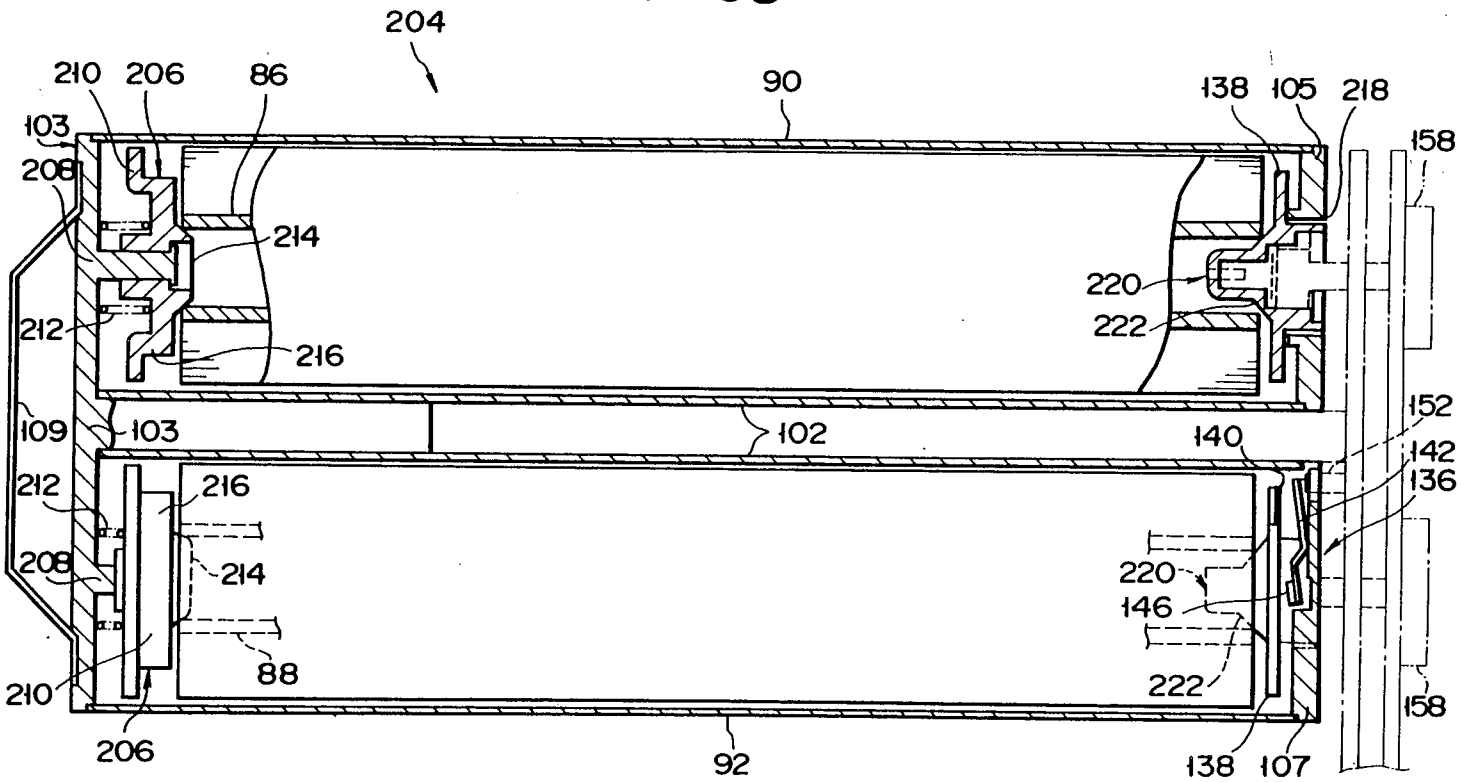
FIG. 38 is a longitudinal sectional view of a ribbon cassette according to a fourth embodiment of the present invention.

A ribbon cassette 204 according to a fourth embodiment of the present invention will be described with reference to FIGS. 38 and 39. A clamping mechanism (clamping means) 206 is arranged in the ribbon cassette 204 to clamp the two ends of each of the roll shafts 86 and 88 so as to easily and detachably hold the roll shafts 86 and 88. Other arrangements of the fourth embodiment are the same as those of the first embodiment. The clamping mechanism 206 will be described in detail hereinafter.

Projections 208 are integrally formed on the inner surface of the side plate 103 at the side of a grip 109 and extend substantially toward the center of the roll shafts 86 and 88, respectively. First supports 210 are disposed on the projections 208 to support the end of the roll shafts 86 and 88. The first supports 210 can be moved along the projection direction (axial direction of the roll shaft 86, 88) and can be rotated about the projections 208. Each first support 210 engages with the free end of the corresponding projection 208 and is rotatably located in position. The first supports 210 are biased toward the distal ends of the projections 208 by coil springs 212 fixed at the projections 208. Truncated conical projections 214 are formed on the first supports 210. Each of the truncated conical projections 214 is fitted in one end of each cylindrical roll shaft 86 or 88. The diameter of a proximal portion 216 of each projection 214 is larger than the inner diameter of the roll shaft 86 or 88.

Through holes 218 are formed at the centers of side plates 105, 107 disposed opposite to a grip 109. Second supports 220 are rotatably fitted into the through holes 218 so as to oppose the first supports 210. Truncated conical projections 222 are formed on the second supports 220 in the same manner as the first supports 210. Each of the projections 222 is fitted in the other end of one of the corresponding cylindrical roll shafts 86 and 88. Projections 226 are formed on the distal ends of the projections 222. Each of the projections 226 is fitted in a notch 224 formed on the other end of each of the roll shafts 86 and 88. Only the notch 224 of the roll shaft 86 and the projection 226 of the second support 220 are illustrated in FIG. 39, but the same construction as described above is utilized at the side of the roll shaft 88.

Figure 39:
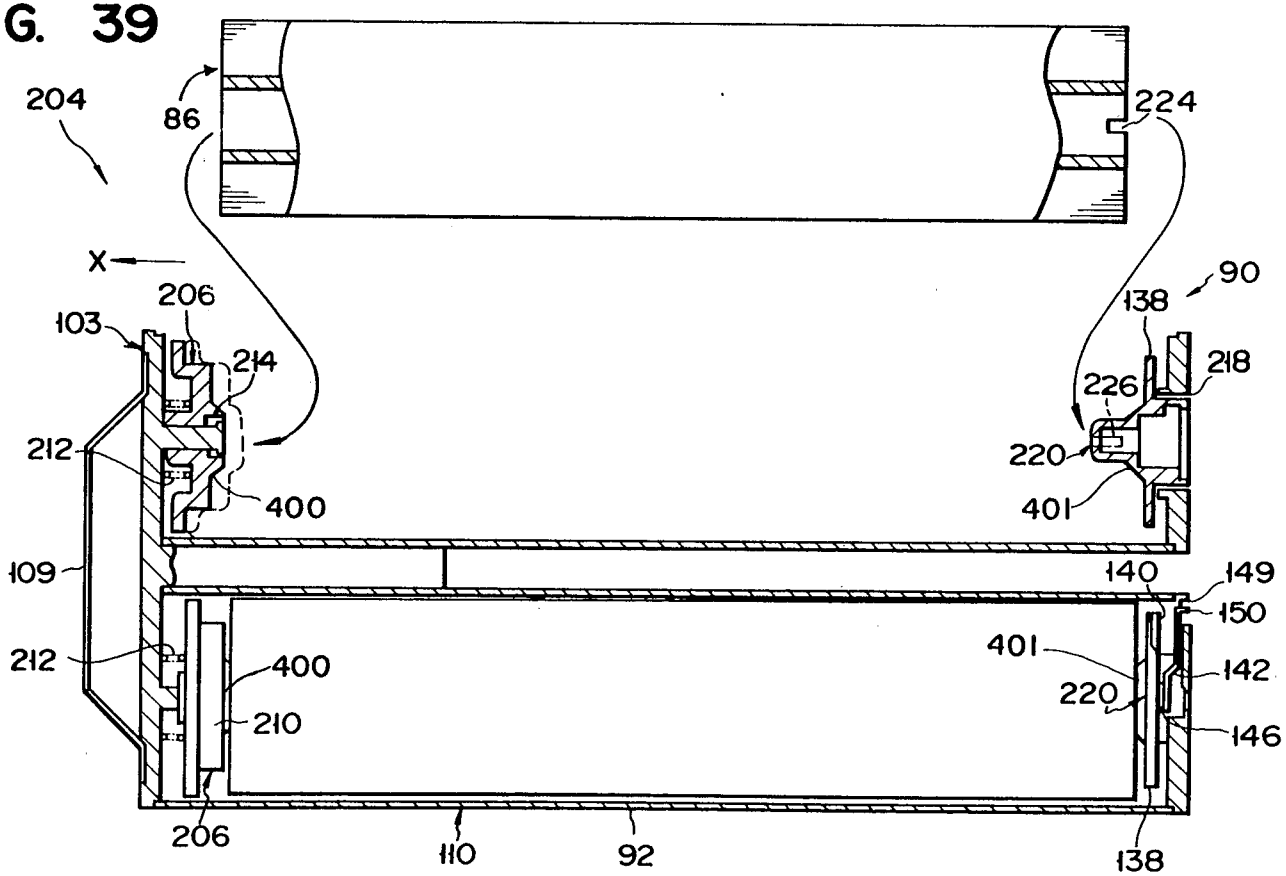
FIG. 39 is a schematic view for explaining the mounting operation of roll shafts in the cassette shown in FIG. 38.

According to the ribbon cassette 204 of the fourth embodiment, when a ribbon 44 is mounted in the ribbon cassette 204, covers 108 and 110 are opened, and the first supports 210 are moved in a direction indicated by arrow X in FIG. 39 to engage the notches 224 of the roll shafts 86 and 88 with the projections 226 of the second supports 220. In this state, the corresponding ends of the roll shafts 86 and 88 are engaged with the first supports 210. When a force along the X direction is released from the first supports 210, the roll shafts 86 and 88 are clamped by the first and second supports 210 and 220, respectively, upon application of the biasing forces of the coil springs 212.

With an operation opposite to that described above, the roll shafts 86 and 88 can be removed. According to the ribbon cassette 204 of the fourth embodiment, since the roll shafts 86 and 88 are clamped and held by the corresponding supports, the roll shafts can be easily removed. In addition, according to this ribbon cassette 204, the first and second supports 210 and 220 for clamping and holding the roll shafts 86 and 88 therebetween have truncated conical projections 400, 401, thereby simplifying the centering of the roll shafts 86, 88.

The present invention is not limited to the particular embodiments described above. Various changes and modifications may be made without departing from the spirit and scope of the invention.

The covers 108, 110 corresponding to the outer surfaces of the roll shafts 86, 88 serving as the lid means can be freely opened/closed, as can the side plate 103 corresponding to the end faces of the roll shafts 86, 88.

What is claimed is:

1. A ribbon cassette cartridge for detachable mounting on a holder of an image transfer device, comprising:

an image transfer device holder for holding said ribbon cassette cartridge;

agent transfer means having first and second ends, for carrying a transfer agent;

a pair of roll shafts including first and second roll shafts respectively coupled to said first and second ends of said agent transfer means; and a case partially surrounding said first and second roll shafts and said agent transfer means, said case including:

a first side portion having an opening therein to cause a portion of said agent transfer means to be exposed;

lid means for opening a portion of said case to provide access to an interior of said case;

a second side portion have a slot extending from one end of said case to over half the distance to another end of said case, said slot for detachably engaging said holder to cause said cartridge to be detachably mounted on said transfer device holder; and holding means for detachably holding said first and second roll shafts in said case, said holding means including lock means for preventing rotation of said first roll shaft when said cartridge is not mounted on said transfer device holder, said lock means including (a) a flange, (b) an arcuate lock lever for frictionally engaging said flange, said arcuate lock lever having (i) a pad at an end of said lever, (ii) a pivot portion about which said lever is rotated, and (iii) a force acting portion for engaging said transfer device holder and causing said lever to pivot to bring said pad out of frictional contact with a face of said flange when said cartridge is installed on said transfer device holder, and (c) a spring coupled to said arcuate lock lever, said spring biasing said arcuate lever to cause said pad to be engaged with said flange face when said cartridge is not installed on said transfer device holder.

2. A device according to claim 1, wherein said lid means comprises hinges and covers pivotally supported by said case through said hinges.

3. A device according to claim 1, wherein said lid means comprises covers which are detachably mounted on said case.

4. A device according to claim 3, wherein said covers comprise engaging means which engage with said case when said covers are closed with respect to said case.

5. A device according to claim 4, wherein said engaging means comprises projections formed on said covers and recesses formed in said case which can be engaged with said projections.

6. A device according to claim 1, wherein said holding means comprises side plates having U-shaped grooves for holding the ends of the pair of roll shafts, and hold plates for surrounding the ends of said pair of roll shafts held in said U-shaped grooves, said hold plates being removed from said U-shaped grooves so as to release said holding means when said covers are opened.

7. A device according to claim 1, wherein said holding means comprises a common side plate having U-shaped grooves for supporting the ends of the pair of roll shafts, and holding levers, one end of each is pivotally supported by said common side plate and the other end of each is engaged with the ends of said pair of roll shafts which are held in said U-shaped grooves when said holding levers are pivoted in one direction.

8. A device according to claim 7, wherein said holding means comprises springs for constantly biasing the other end of each of said holding levers toward the ends of said pair of roll shaft which are held by said U-shaped grooves of said common side plate.

9. A device according to claim 8, wherein said holding means includes first and second end plates, disposed on an opposite side of said holding means from said common side plate, wherein a hole is formed in one of said end plates at a position corresponding to said force acting portion, a projection formed on said transfer device holder urges said force acting portion through said hole against the biasing force of said spring so as to separate said pad from said flange when said cartridge is installed on said transfer device holder.

10. A device according to claim 9, wherein said holding means comprises clamping means for clamping the ends of said pair of roll shafts along an opposing axial direction thereof.

11. A device according to claim 10, wherein said clamping means comprises supports which are movable along the axial direction of said pair of roll shafts and which can be engaged therewith, and springs for biasing said supports toward said pair of roll shafts.

12. A device according to claim 11, wherein said pair of roll shafts have a cylindrical shape, said supports have truncated conical portions which respectively engage with said pair of roll shafts, said roll shafts being engaged with said truncated conical portions of said supports, thereby simplifying indexing of said pair of roll shafts.

13. A device according to claim 1, wherein said case comprises two separate case portions for respectively storing said pair of roll shafts.

14. A device according to claim 13, wherein said two case portions have a projection and a recess, respectively, which are provided to connect said two case portions.

* * * * *